US011603991B2

(12) United States Patent
Akbarimonfared et al.

(10) Patent No.: US 11,603,991 B2
(45) Date of Patent: Mar. 14, 2023

(54) OPTIMIZED BURNERS FOR BOILER APPLICATIONS

(71) Applicant: Rheem Manufacturing Company, Atlanta, GA (US)

(72) Inventors: Amin Akbarimonfared, Woodland Hills, CA (US); Timothy J. Shellenberger, Tyrone, GA (US); Leonard E. Chambers, Oxnard, CA (US); Christopher Hertzberg, Moorpark, CA (US); Juan Cervantes, Oxnard, CA (US)

(73) Assignee: RHEEM MANUFACTURING COMPANY, Atlanta, GA (US)

( * ) Notice: Subject to any disclaimer, the term of this patent is extended or adjusted under 35 U.S.C. 154(b) by 612 days.

(21) Appl. No.: 16/706,506

(22) Filed: Dec. 6, 2019

(65) Prior Publication Data

US 2020/0116351 A1 Apr. 16, 2020

Related U.S. Application Data

(63) Continuation of application No. PCT/US2018/036730, filed on Jun. 8, 2018.

(60) Provisional application No. 62/517,016, filed on Jun. 8, 2017.

(51) Int. Cl.
*F23D 14/84* (2006.01)

(52) U.S. Cl.
CPC ..... *F23D 14/84* (2013.01); *F23D 2210/00* (2013.01)

(58) Field of Classification Search
None
See application file for complete search history.

(56) References Cited

U.S. PATENT DOCUMENTS

| | | | | |
|---|---|---|---|---|
| 4,641,631 | A | 2/1987 | Jatana | |
| 2012/0210917 | A1* | 8/2012 | Belasse | F23D 1/00 110/297 |

FOREIGN PATENT DOCUMENTS

| | | | | |
|---|---|---|---|---|
| CN | 101861496 | A1 | 10/2010 | |
| CN | 105934638 | A | 9/2016 | |
| WO | WO-9740315 | A1 * | 10/1997 | F23C 7/00 |
| WO | 2009/077505 | A2 | 6/2009 | |
| WO | 2012/069534 | A1 | 5/2012 | |

OTHER PUBLICATIONS

English translation of WO 9740315.*
Supplementary European Search Report and Opinion for European Patent Application No. 18812674.2 dated Feb. 2, 2021, 9 pages.
Office Action issued for Chinese Patent Application No. 201880044634.3 dated Jun. 24, 2021.

* cited by examiner

*Primary Examiner* — Jason Lau
(74) *Attorney, Agent, or Firm* — Eversheds Sutherland (US) LLP

(57) ABSTRACT

A boiler can have a combustion chamber, a burner, a heat exchanger in fluid communication with the combustion chamber, and a flue for removing a combustion product from the boiler. The burner has a protruding taper shape such as a cone or similar shape. The protruding taper shape of the burner distributes heat to the heat exchanger more evenly than a cylindrical shaped burner thereby reducing heat losses at the combustion chamber wall and increasing the thermal efficiency. The protruding taper shape of the burner also reduces noise associated with the operation of the burner.

19 Claims, 8 Drawing Sheets

| $CO_2$ | Firing Rates with Harmonics |
|---|---|
| ~8% | ~10-15% and Below |
| ~8.8% | ~25-30% and Below |
| ~9.5% | ~50-60% and Below |

OPTIMIZED BURNERS FOR BOILER APPLICATIONS

RELATED APPLICATIONS

The present application is a continuation application of and claims priority to PCT Patent Application No. PCT/US2018/036730 filed on Jun. 8, 2018 and titled "Optimized Burners For Boiler Applications," which claims priority to U.S. Provisional Patent Application No. 62/517,016 filed on Jun. 8, 2017 and titled "Optimized Burners For Boiler Applications". The entire content of the foregoing applications is incorporated herein by reference.

TECHNICAL FIELD

The present disclosure relates generally to boilers and particularly to the shape of the burner used in boilers.

BACKGROUND

Boilers, water heaters, and other similar devices are used to heat various types of liquids. These devices often use a burner in connection with a combustion process. One of the limitations with existing burners is that they may not evenly distribute heat and instead concentrate too much heat on a tube sheet or other part of the device. Another limitation with existing burners is that at low firing rates, the burner and surrounding components may generate significant noise referred to herein as harmonics. Noise or harmonics is a particular problem in boilers with combustion chambers that are sealed or enclosed except for an opening to a heat exchanger and an opening for the gas and fuel mixture inlet. Those of ordinary skill working in the design of boilers will understand that harmonics refers to the natural frequency or integer multiples of the natural frequency of noise generated from the operation of the burner. The natural frequency of the burner is determined by the shape and materials used for the combustion chamber and the burner.

Referring to the attached figures, FIG. 1 is a schematic diagram showing the primary components of a typical boiler known in the prior art. Specifically, FIG. 1 illustrates boiler 100 with water inlet 114, water outlet 115, combustion chamber 108, heat exchanger 109, and flue gas outlet 116. Air is provided to a blower 105 and manifold 106 via an air input 102 and fuel is provided to the blower 105 and manifold 106 via a fuel input 104. The fuel and air mixture is received at the burner 110 within the combustion chamber 108 where they are ignited to produce a combustion product. The combustion product flows under the pressure of the blower 105 through the heat exchanger 109 to heat water within the boiler 100. After transferring heat to the water, the combustion products exit the boiler via the flue gas outlet 116. In the example illustrated in FIG. 1, the combustion chamber 108 has a cylindrical shape and is enclosed except for a combustion chamber inlet 107, in which the burner 110 is placed, and a combustion chamber outlet 111. The combustion chamber outlet 111 is in fluid communication with a heat exchanger inlet 112. A heat exchanger outlet 113 is in fluid communication with the flue gas outlet 116.

FIG. 2 shows a cross-sectional schematic illustration of the prior art burner 110 having a cylindrical shape and installed in the combustion chamber 108 of a prior art boiler 100. FIG. 3 provides an inverted view of a typical burner 110 having a cylindrical shape with a flat bottom surface and curved side wall and wherein the burner 110 is attached to a manifold 106 as known in the prior art.

As illustrated in FIG. 2 with the arrows pointing downward from the burner 110, the cylindrical-shaped burner 110 directs a significant portion of heat to the area of the tube sheet 120 directly below the cylindrical-shaped burner 110. The tube sheet 120 is a plate at the top of the heat exchanger 109 that secures the heat exchanger tubes. As a result of this concentration of heat at the center of the tube sheet 120, heat is not evenly distributed to the plurality of heat exchanger tubes located below the tube sheet 120 resulting in inefficient operation of the tubes of the heat exchanger 109. The concentration of heat at the center of the tube sheet 120 also creates mechanical stress on the tube sheet 120 and particularly at the weld joining the tube sheet 120 to the heat exchanger tubes where the temperatures of the heat exchanger are the highest. This mechanical stress can affect the performance and longevity of the boiler.

As also shown by the horizontal arrows pointing out from each side of the burner 110 in FIG. 2, the curved side wall of the cylindrical burner 110 directs heat outward towards the sides of the combustion chamber 108 where there are heat losses at the wall of the combustion chamber 108, thereby further compounding the inefficient distribution of heat from the burner. Because the heat leaving the curved side wall of the cylindrical burner is not focused toward the heat exchanger below the tube sheet 120, the operation of the boiler is less efficient. Instead, it would be optimal to increase the heat directed downward toward the tube sheet 120 and the tubes of the heat exchanger 109 and to also distribute the heat more evenly over the tube sheet 120 and the tubes of the heat exchanger 109.

As illustrated in FIGS. 4 and 5, another limitation with the cylindrical-shaped burner 110 known in the prior art is the noise, or harmonics, created by the burner 110 and the surrounding components of the boiler 100. Harmonics occur when the burner 110 is firing at a low rate. The lower air pressures associated with lower firing rates along with the shape of the burner 110, the shape of the manifold 106 above the burner 110, and the shape of the combustion chamber 108 combine to produce harmonics. The data provided in FIGS. 4 and 5 are the results of testing on a 12 inch cylindrical burner operating at 2.5 MM BTU/hour as a non-limiting example. As the data in FIGS. 4 and 5 shows, when the carbon dioxide level is at approximately 8%, harmonics are produced when the firing rate of the burner is 10-15% or lower of the full firing rate capacity. The data also shows that as the carbon dioxide level increases to 9.5%, the range of firing rates that produce harmonics increases substantially up to 50-60% or lower of the full firing rate capacity.

The following disclosure describes example burners that can address one or more of the foregoing limitations associated with heat distribution and harmonics.

SUMMARY

The present disclosure relates to optimizing a burner for a boiler. In one example embodiment, the boiler comprises a combustion chamber having a combustion chamber inlet and a combustion chamber outlet. A burner with a protruding taper shape is disposed in the combustion chamber inlet and protrudes into the combustion chamber. As some non-limiting examples, the protruding taper shape of the burner can be a cone, a truncated cone, a hemisphere, a hemispheroid, a dome, an elliptical dome, a pyramid, a truncated pyramid, or a quasi-pyramid. The burner is configured to receive a mixture of air and fuel. The boiler further comprises a heat exchanger with a heat exchanger inlet that is in fluid communication with the combustion chamber. A flue is in fluid communication with the heat exchanger outlet for removing a combustion product after the combustion product passes through the heat exchanger. In certain example embodiments, the burner may comprise a mesh with a non-uniform perforation pattern or a diffuser plate with a non-uniform perforation pattern.

These and other aspects, objects, features and embodiments will be apparent from the following description and the appended claims.

BRIEF DESCRIPTION OF THE DRAWINGS

Reference will now be made to the accompanying drawings, which are not necessarily drawn to scale, and wherein.

DESCRIPTION OF EXAMPLE EMBODIMENTS

The example embodiments discussed herein are directed to systems, apparatuses, and methods for burners with optimized shapes, such as a conical shape or other similar type of protruding tapered shape. While conical shaped burners have been used in other applications, such as the rich-lean or low NOx system described in U.S. Patent Application Publication No. 2013/0312700, burners having a conical or protruding tapered shape have not been used in systems with sealed combustion chambers with a pre-mixed supply of fuel and gas such as the boilers described herein. The following embodiments are non-limiting examples and those working in this field should understand that various modifications can be applied to the examples described herein without departing from the scope of this disclosure.

Figure 6:
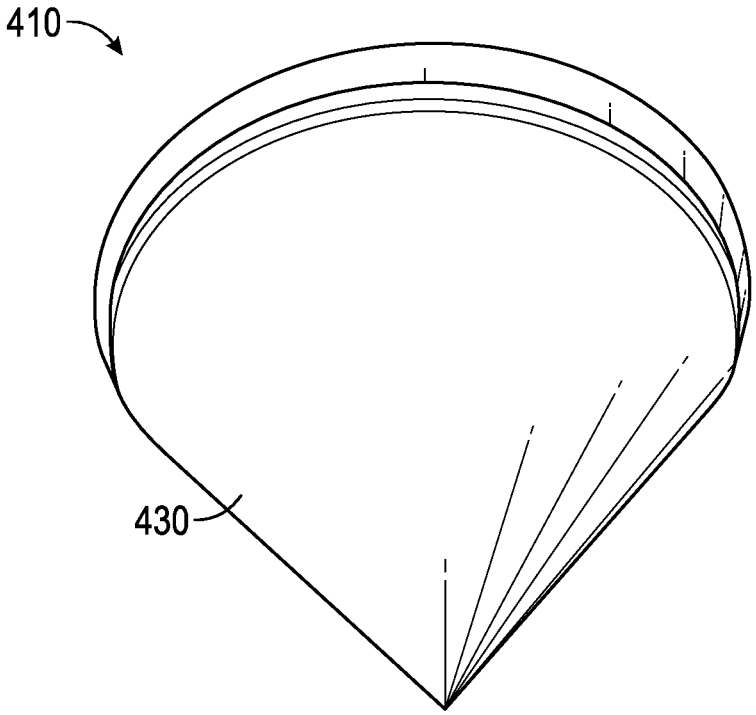
FIG. 6 illustrates a conical-shaped burner in accordance with the example embodiments of this disclosure.
Figure 7:
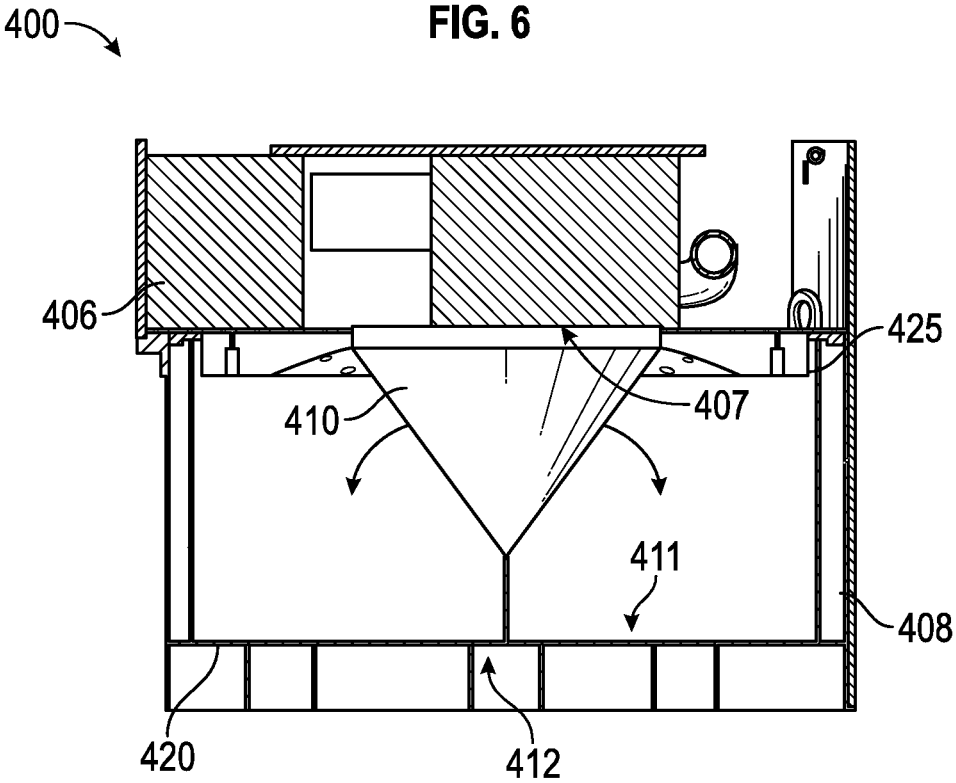
FIG. 7 is a schematic illustration of a partial cross-section of a boiler showing a conical-shaped burner in accordance with the example embodiments of this disclosure.
Figure 8:
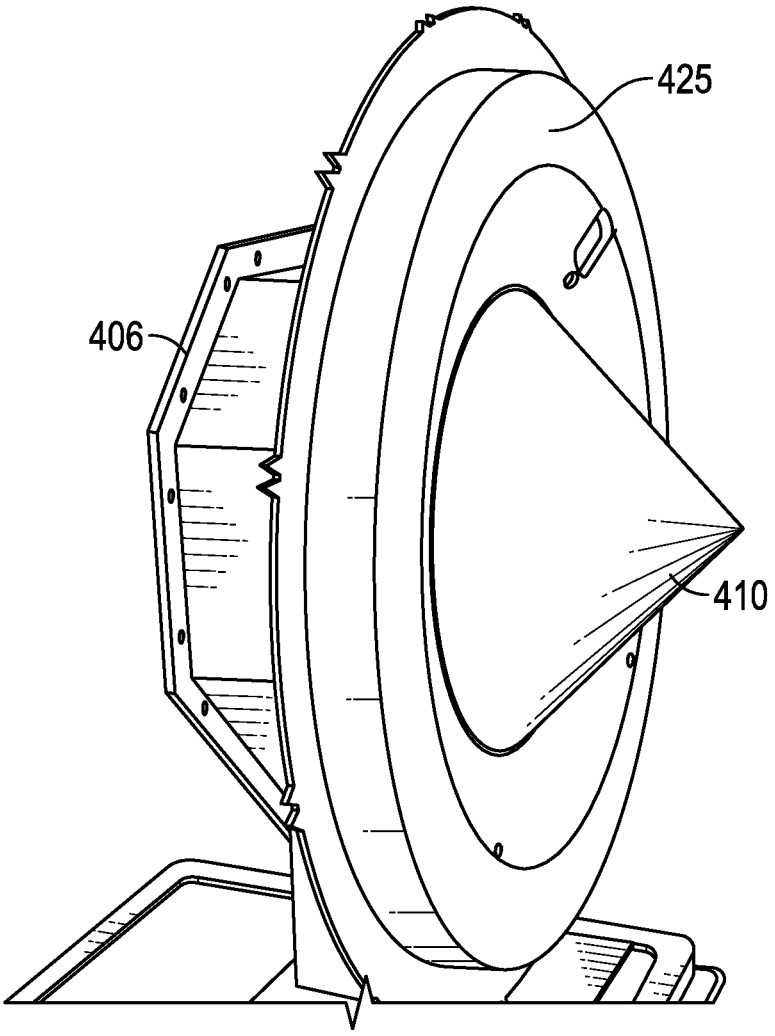
FIG. 8 illustrates a conical burner in accordance with the example embodiments of this disclosure.

Referring to FIGS. 6, 7, 8, and 10, example embodiments of conical-shaped burners are shown for use in a heating device such as a boiler. FIG. 6 illustrates an example conical-shaped burner 410. In the example shown in FIG. 6, the conical-shaped burner 410 comprises multiple layers with an outer mesh layer 430 that has a plurality of apertures. As illustrated in the schematic partial cross-section of a boiler 400 shown in FIG. 7, the conical-shaped burner 410 can be attached to a manifold 406 and protrude into a combustion chamber 408 at the combustion chamber inlet 407 and towards a combustion chamber outlet 411 and a tube sheet 420. The heat exchanger is located below the tube sheet 420 with the heat exchanger inlet 412 adjacent to the tube sheet 420. In the example shown in FIG. 7, the conical-shaped burner is surrounded by an optional ceramic refractory 425. Another view of the burner 410, ceramic refractory 425, and manifold 406 is also shown in FIG. 8.

Figure 10:
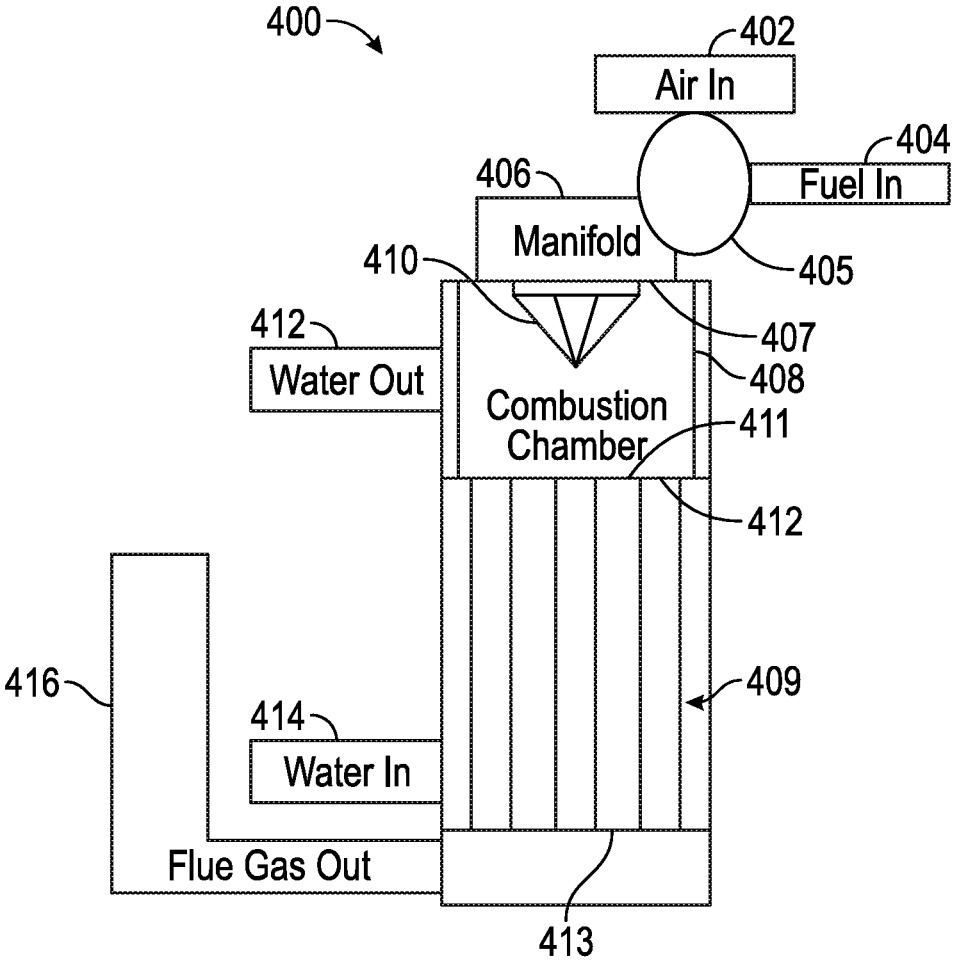
FIG. 10 is a schematic illustration of the primary components of a boiler in accordance with the example embodiments of this disclosure.

FIG. 10 illustrates the primary components of boiler 400 with water inlet 414, water outlet 415, combustion chamber 408, heat exchanger 409, and flue gas outlet 416 in accordance with example embodiments of the present disclosure. Air is provided to a blower 405 and manifold 406 via an air input 402 and fuel is provided to the blower 405 and manifold 406 via a fuel input 404. The fuel and air mixture is received at the conical-shaped burner 410 disposed at the combustion chamber inlet 407 where the mixture is ignited to produce a combustion product. The combustion product flows under the pressure of the blower 405 through the combustion chamber outlet 411, the tube sheet 420, and the heat exchanger inlet 412 to heat water flowing around the heat exchanger 409 within the boiler 400. After transferring heat to the water, the combustion products exit the heat exchanger outlet 413 to the flue gas outlet 116. In the example illustrated in FIG. 10, the combustion chamber 408 has a cylindrical shape and is enclosed except for the combustion chamber inlet 407, in which the burner 410 is placed, and the combustion chamber outlet 411.

Figure 1:
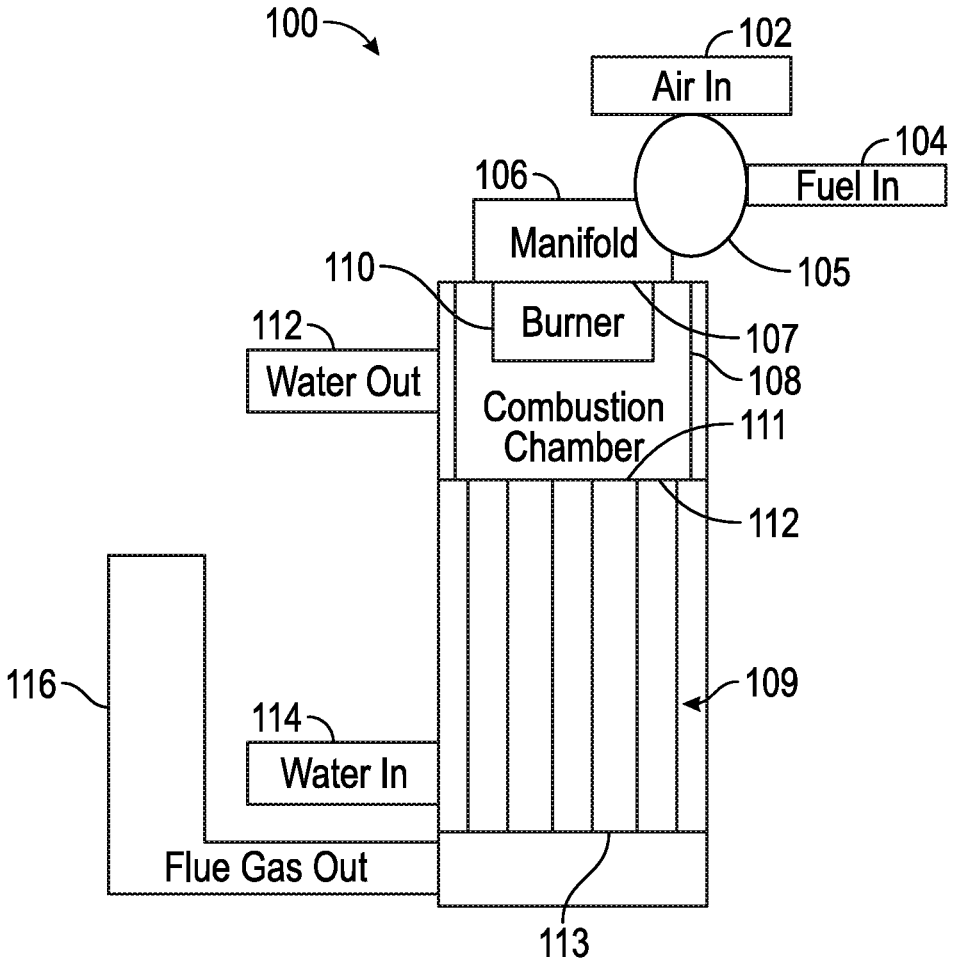
FIG. 1 (Prior Art)
FIG. 1 is a schematic illustration of the primary components of a boiler as known in the prior art.
Figure 2:
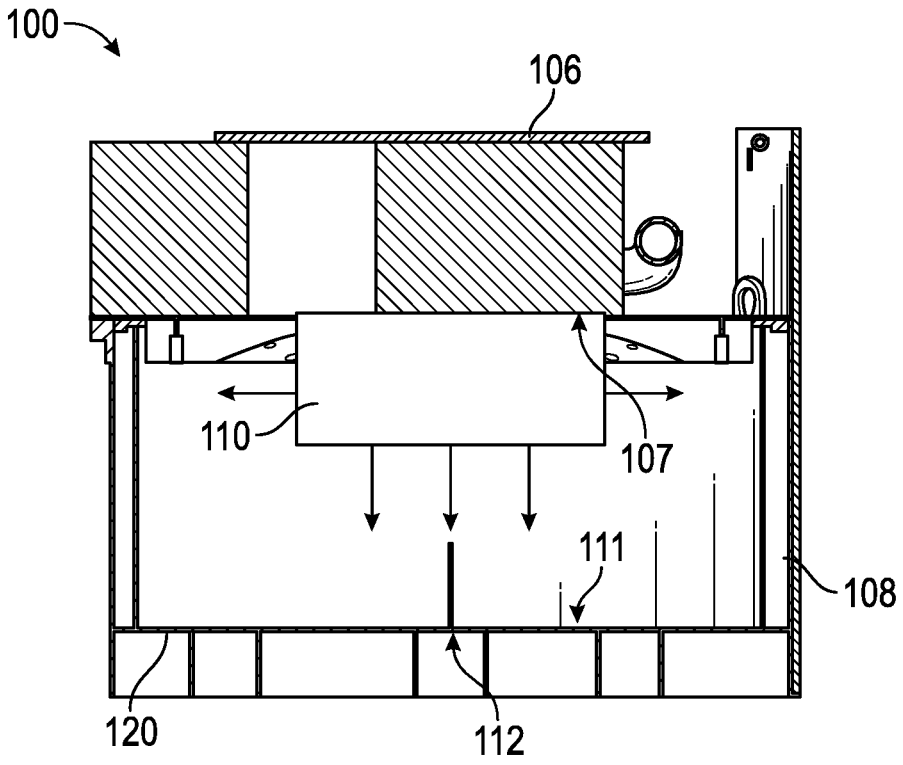
FIG. 2 (Prior Art)
FIG. 2 is a schematic illustration of a partial cross-section of a prior art boiler showing a cylindrical-shaped burner located within the combustion chamber and below the manifold of a prior art boiler.
Figure 3:
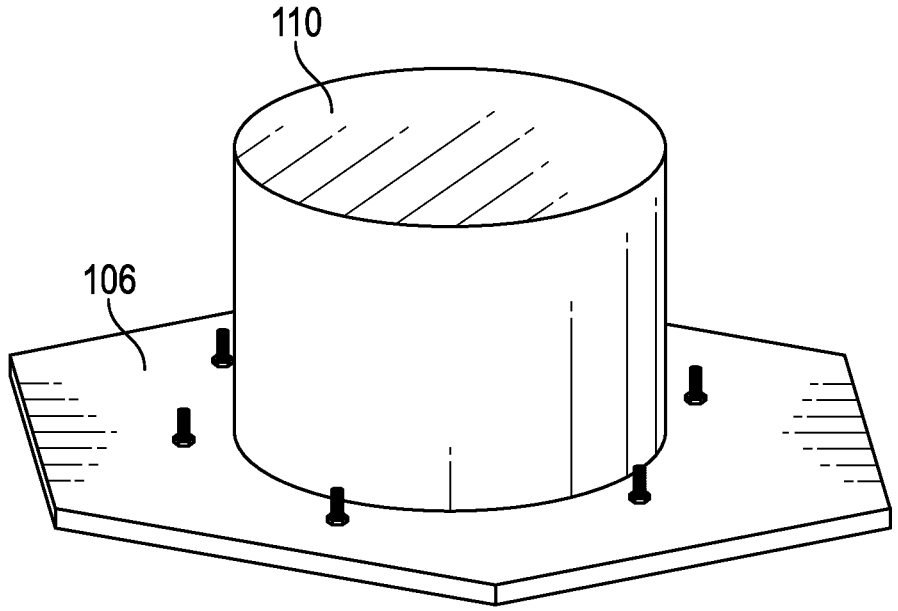
FIG. 3 (Prior Art)
FIG. 3 shows a cylindrical-shaped burner known in the prior art.
Figures 4, 5:
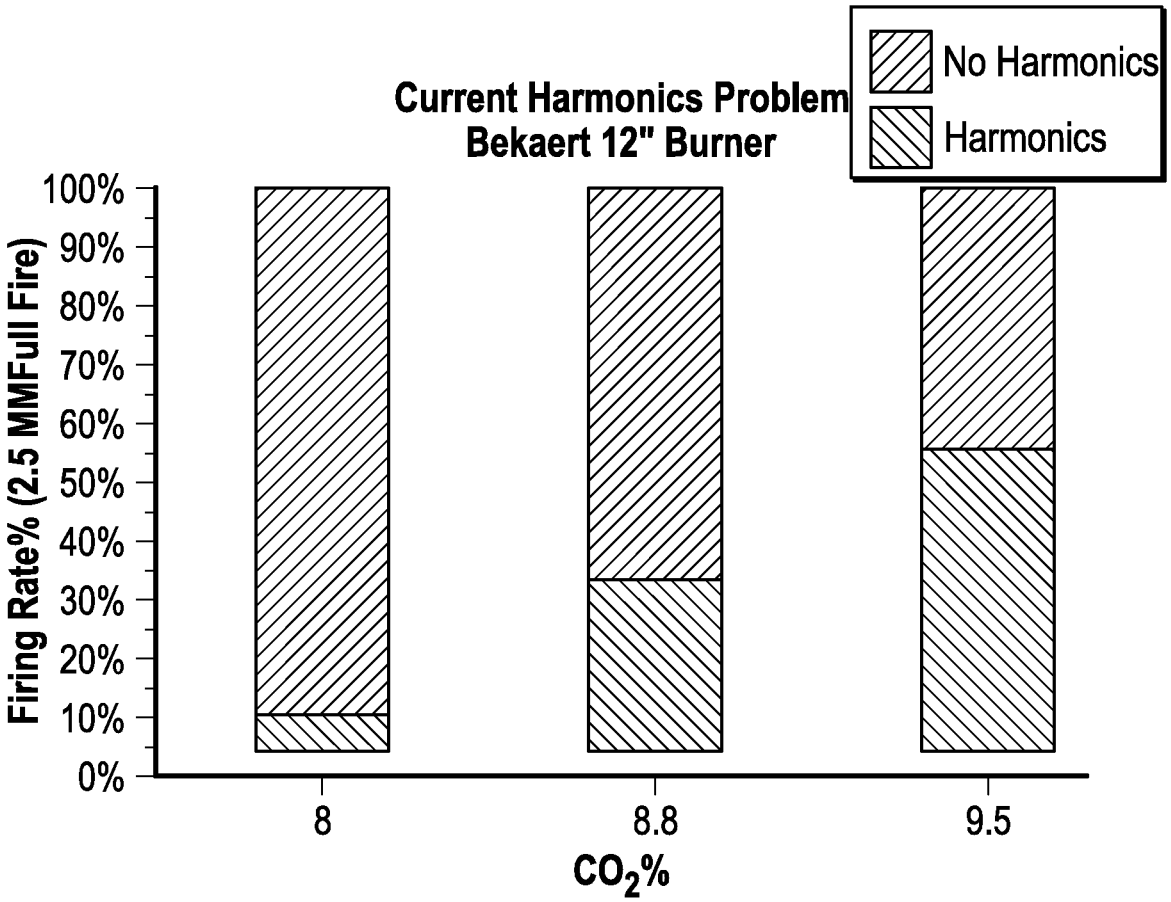
FIG. 4 (Prior Art)
FIG. 5 (Prior Art)
FIG. 4 is a table and FIG. 5 is a graph, both of which contain data reflecting the occurrence of harmonics in prior art boilers at specified carbon dioxide levels and firing rates.

Referring again to FIG. 7, the schematic partial cross-section illustration includes arrows pointing outward and downward from the angled sides of the conical-shaped burner 410 showing the flow of combustion gases and associated heat directed from the conical-shaped burner 410 toward the heat exchanger below the tube sheet 420. In contrast to the cylindrical-shaped burner illustrated in FIG. 2, the conical-shaped burner 410 does not concentrate heat at the center of the tube sheet 420. Instead, as illustrated by the arrows shown in FIG. 7, the conical-shaped burner 410 provides a more even distribution of heat towards the tube sheet 420 and the heat exchanger tubes located below the tube sheet 420. Additionally, the heat leaving the sides of the conical shaped burner 410 is directed at a downward angle toward the tube sheet 420 in contrast with the inefficient horizontal direction of heat from the sides of the prior art cylindrical-shaped burner shown in FIG. 2. Therefore, the conical-shaped burner 410 directs heat towards the tube sheet 420 and the heat exchanger tubes in a more even and efficient distribution. The more even and efficient distribution of heat achieved with the conical-shaped burner 410 reduces the concentration of heat in the center of the tube sheet encountered with the prior art cylindrical burner. Reducing the concentration of heat in turn reduces mechanical stresses at the tube sheet 420 and at the weld joining the tube sheet 420 and the heat exchanger 409 thereby improving the longevity of the boiler. The more even and efficient distribution of heat also permits the heat exchanger to operate more efficiently because the tubes of the heat exchanger receive a more evenly distributed quantity of heat.

Figure 11:
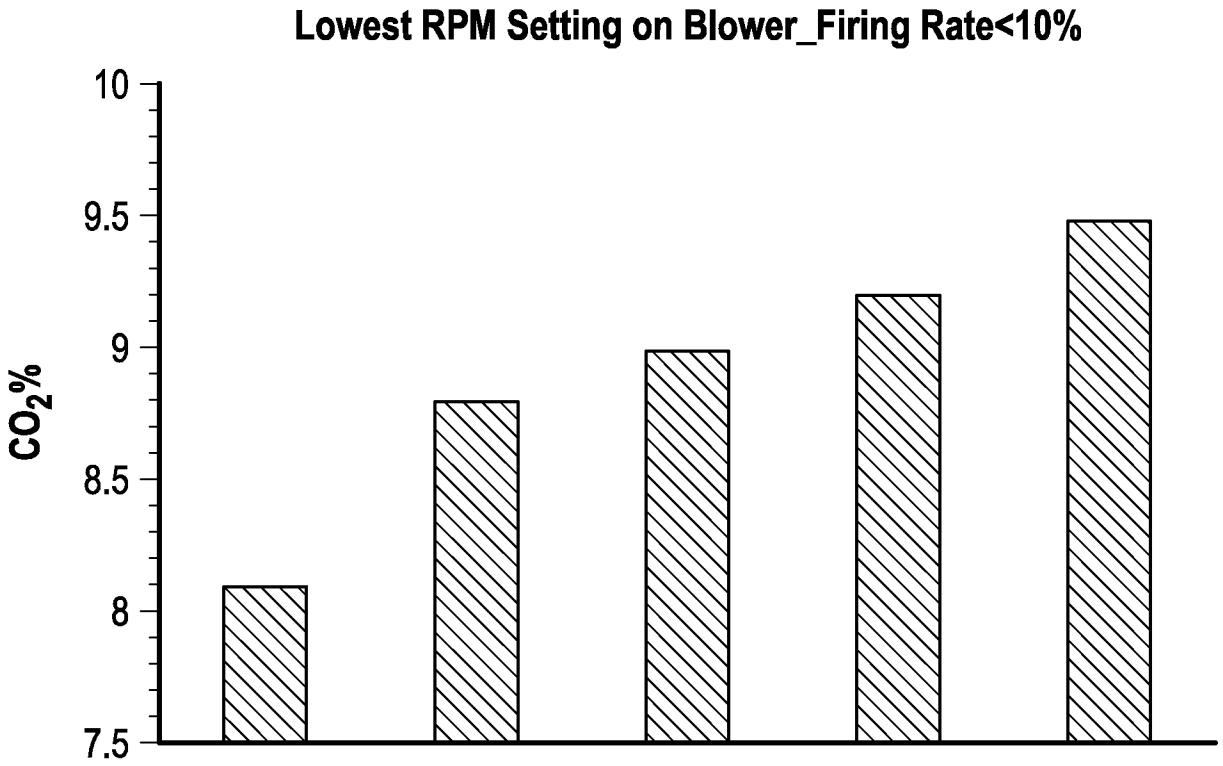
FIG. 11 and FIG. 12 are graphs both of which contain data reflecting the absence of harmonics for a boiler in accordance with the example embodiments of this disclosure.
Figure 12:
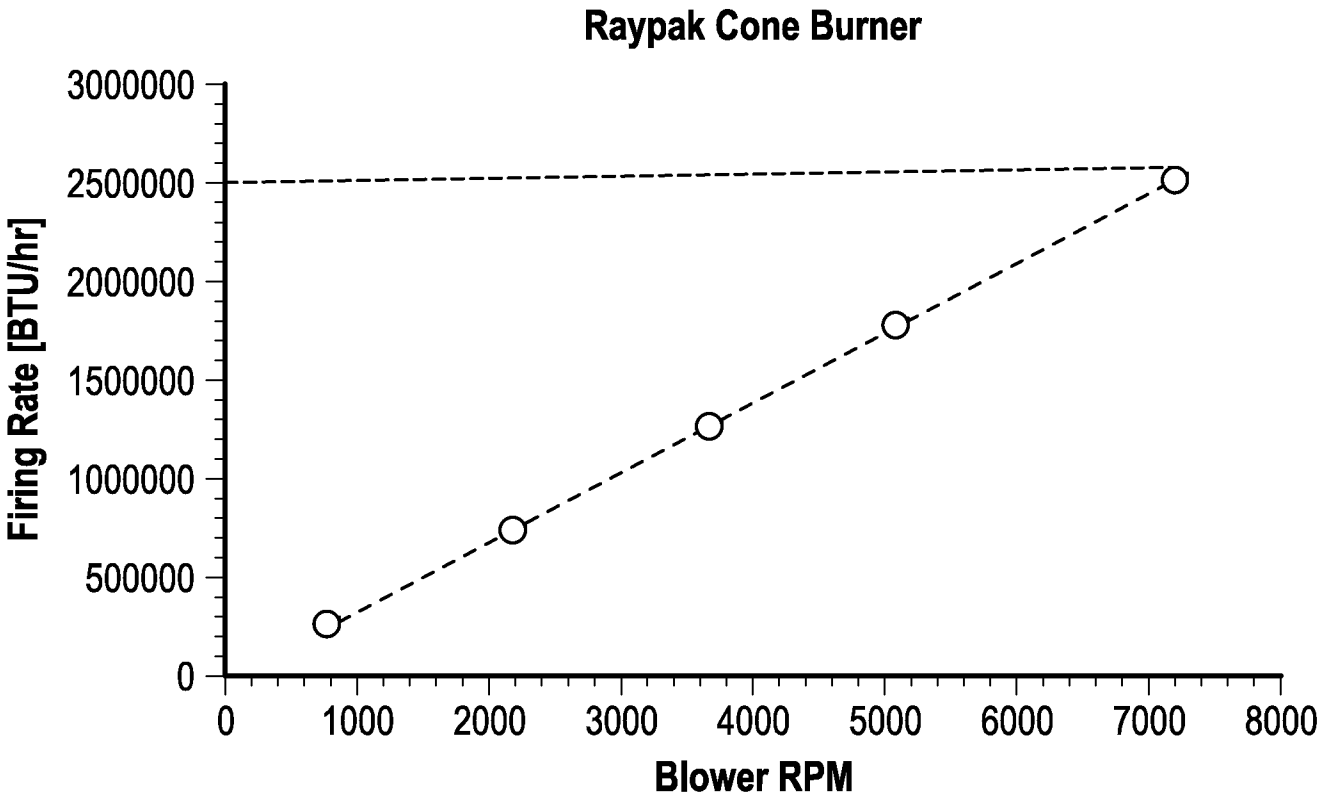

The graphs illustrated in FIGS. 11 and 12 contain test data for an example boiler with a protruding tapered burner in accordance with the embodiments described herein. The test data shown in FIGS. 11 and 12 was collected from a boiler having a conical-shaped burner and a capacity of 3 million BTU/hour, however, the conclusions drawn from the test data and the embodiments described herein can be applied to other types of boilers and water heaters with other types of protruding tapered burners. The data illustrated in the graphs in FIGS. 11 and 12 shows that the conical shape of the burner reduces or completely eliminates harmonics.

Specifically, FIG. 11 shows test data collected for carbon dioxide levels in the burner ranging from 7.5% to 9.5% with natural gas as the fuel, with the speed of the blower set to 800 rpm, and with the firing rate of the burner set to 250,000 BTU/hour. For each of the tests shown in FIG. 11 at different carbon dioxide levels, no harmonics were detected during the tests. The success of the tests over the range of 7.5% to 9.5% carbon dioxide in the burner demonstrates that the conical-shaped burner will be successful at reducing harmonics over a range of fuel and air ratios. FIG. 12 illustrates test data collected from the same boiler as the test data in FIG. 11. The test data in FIG. 12 was collected while varying the blower speed from 800 to 7200 rpm and while varying the firing rate of the burner from 200,000 to 2.5 million BTU/hour. As with the testing associated with FIG. 11, no harmonics were detected during the testing illustrated by the data in FIG. 12. As another example, the protruding taper shape of the burner eliminates harmonics emanating from the boiler at a firing rate between 2% and 40% of the maximum firing rating for the boiler and at a carbon dioxide range of 7% to 11.7% for a natural gas fuel.

The protruding taper shape of the burner is particularly advantageous for both even heat distribution and noise reduction in the type of boiler illustrated in FIGS. 7 and 10. Specifically, the protruding taper shaped burner provides advantages over a cylindrical shaped burner for a boiler having only a single burner that is centered and mounted to a manifold and positioned within a combustion chamber where the combustion chamber is enclosed or sealed except for a combustion chamber inlet, that receives a fuel and air mixture, and a combustion chamber outlet, that discharges the heated combustion product to the heat exchanger. As another example, for a boiler having a single burner wherein the height of the burner is more than half the height of the combustion chamber and the width of the burner is more than one-third the width of the combustion chamber, a protruding taper shaped burner provides advantages over a cylindrical shaped burner with respect to more even heat distribution and reduction of noise.

The improvement in harmonics associated with the testing illustrated in FIGS. 11 and 12 relates to the shape of the burner being different from the shape of the manifold and the combustion chamber. While the data illustrated in FIGS. 11 and 12 pertains to a conical-shaped burner used in a particular boiler, it should be understood that the improvements described herein can be applied to a variety of boilers and heating devices using varying optimized shapes for the burner or burners used in the device. As one non-limiting example, forming the burner so that it has a protruding taper shape is one class of shapes that provides one or more of the benefits described herein. The burner is described as a protruding taper in that it protrudes from the manifold toward the heat exchanger and the end of the burner closer to the heat exchanger is tapered or has a smaller cross-section than the end of the burner closer to the manifold. Several non-limiting examples of protruding taper shapes for the burner are described further below.

Figure 9A:
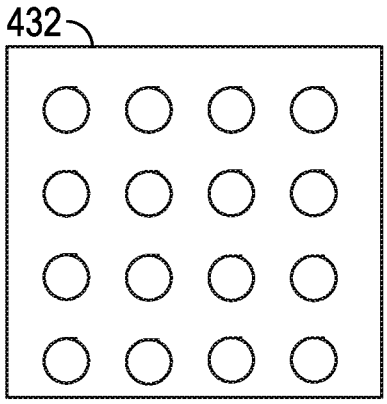
FIGS. 9*a* and 9*b* show representations of varying perforation patterns that can be used in the burner mesh or the optional diffuser plate in accordance with the example embodiments of this disclosure.
Figure 9B:
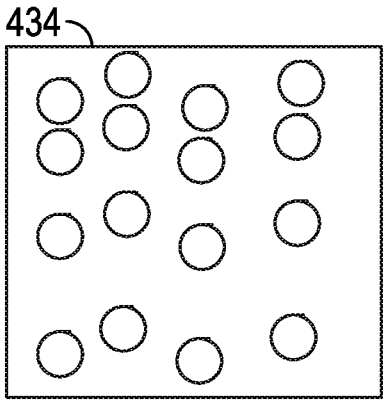

Referring to FIGS. 9*a* and 9*b*, examples of perforation patterns for the outer mesh layer 430 of the burner are shown. The pattern of the mesh 432 shown in FIG. 9*a* is a uniform perforation pattern where the apertures are spaced from each other at substantially the same distance in the horizontal and vertical directions along the mesh 432. In contrast, the pattern of the mesh 434 shown in FIG. 9*b* is a non-uniform perforation pattern where the apertures are not spaced from each other at substantially the same distance in the horizontal and vertical directions. The perforation patterns shown in FIG. 7 can be applied to the mesh layer of the burner.

Additionally or as an alternative to applying the perforation patterns to the mesh layer 430, the perforation patterns can be applied to an optional diffuser plate located between the manifold 406 and the burner 410. Altering the perforation pattern can alter the distribution of heat from the burner for varying applications. In other example embodiments, other perforation patterns can be employed, such as patterns that cluster the perforations in a particular area of the mesh layer or diffuser plate. Moreover, different shapes of the perforations, such circular, oval, and slotted, can be used to control the heat distribution. The diffuser plate can be made of one or more of a variety of materials including, as non-limiting examples, stainless steel and Inconel. The mesh layer on the burner likewise can be made using one or more of a variety of materials including, but not limited to, Inconel, iron and chromium. The mesh layer can also be manufactured using a variety of different processes including knitting, weaving, and sintering.

The optimized shape of the burner of the embodiments described herein can take a variety of forms. A general embodiment of the optimized burner can have a protruding taper shape. In one alternate example, the narrow end of the cone can be truncated instead of pointed. Additionally, the angle of the cone can be varied. Other examples of protruding taper shapes for the burner that can achieve one or more of the benefits described herein include hemispherical, dome, elliptical dome, pyramidal, truncated pyramid, and pyramids with different numbers of sides and different angled sides. These variations on the shape of the conical burner can be applied to optimize different applications.

While example embodiments of conical-shaped burners are discussed herein, the principles of the described embodiments can be applied to a variety of types of burners. Accordingly, many modifications of the embodiments set forth herein will come to mind to one skilled in the art having the benefit of the teachings presented in the foregoing descriptions and the associated drawings. Therefore, it is to be understood that conical-shaped burners are not to be limited to the specific embodiments disclosed and that modifications and other embodiments are intended to be included within the scope of this application. Although specific terms are employed herein, they are used in a generic and descriptive sense only and not for purposes of limitation.

What is claimed is:

1. A boiler comprising:

a combustion chamber that is enclosed except for a combustion chamber inlet and a combustion chamber outlet;

a burner disposed at the combustion chamber inlet of the combustion chamber, the burner having a protruding taper shape, the burner configured to receive a mixture of air and fuel, wherein the burner comprises a mesh with a non-uniform perforation pattern, such that at least three apertures are separated from each other at inconsistent distances, wherein the protruding taper shape of the burner eliminates harmonics emanating from the boiler at a firing rate between 2% and 40% of the maximum firing rating for the boiler and at a carbon dioxide range of 7% to 11.7% for a natural gas fuel;

a heat exchanger having a heat exchanger inlet and a heat exchanger outlet, the heat exchanger inlet in fluid communication with the combustion chamber outlet of the combustion chamber; and a flue in fluid communication with the heat exchanger outlet for removing combustion product from the heat exchanger outlet.

2. The boiler of claim 1, wherein the protruding taper shape of the burner is one of: a cone, a truncated cone, a hemisphere, a hemispheroid, a dome, an elliptical dome, a pyramid, a truncated pyramid, and a quasi-pyramid.

3. The boiler of claim 1, further comprising a diffuser plate disposed between the burner and a manifold, the diffuser plate having a non-uniform perforation pattern.

4. The boiler of claim 1, further comprising a ceramic refractory surrounding the burner.

5. The boiler of claim 1, wherein the protruding taper shape of the burner eliminates harmonics emanating from the boiler.

6. The boiler of claim 1, wherein the combustion chamber is cylindrical in shape.

7. The boiler of claim 1, further comprising a manifold that receives air from an air input and fuel from a fuel input and provides the mixture of air and fuel to the burner.

8. The boiler of claim 7, wherein the manifold comprise a body and a flange.

9. The boiler of claim 8, wherein the body of the manifold has a cylindrical shape.

10. The boiler of claim 7, wherein the burner is attached to the manifold.

11. The boiler of claim 10, wherein the burner comprises a widest portion adjacent to the manifold.

12. The boiler of claim 11, wherein the burner comprises a narrowest portion that is farthest from the manifold.

13. The boiler of claim 1, further comprising a tube sheet disposed at the combustion chamber outlet.

14. The boiler of claim 13, wherein the protruding taper shape of the burner distributes heat more evenly towards the heat exchanger.

15. The boiler of claim 1, wherein the height of the burner is more than half the height of the combustion chamber.

16. The boiler of claim 15, wherein the width of the burner is more than one-third the width of the combustion chamber.

17. The boiler of claim 16, wherein the burner is the only burner in the boiler.

18. The boiler of claim 13, wherein the tube sheet is welded to the heat exchanger.

19. A boiler comprising:

a combustion chamber that is enclosed except for a combustion chamber inlet and a combustion chamber outlet;

a burner disposed at the combustion chamber inlet of the combustion chamber, the burner having a protruding taper shape, the burner configured to receive a mixture of air and fuel, wherein the protruding taper shape of the burner eliminates harmonics emanating from the boiler at a firing rate between 2% and 40% of the maximum firing rating for the boiler and at a carbon dioxide range of 7% to 11.7% for a natural gas fuel;

a heat exchanger having a heat exchanger inlet and a heat exchanger outlet, the heat exchanger inlet in fluid communication with the combustion chamber outlet of the combustion chamber; and a flue in fluid communication with the heat exchanger outlet for removing combustion product from the heat exchanger outlet.

* * * * *